US007463837B2

(12) United States Patent
Yasutomi

(10) Patent No.: US 7,463,837 B2
(45) Date of Patent: Dec. 9, 2008

(54) IMAGE FORMING APPARATUS WITH SUPERIMPOSED DARK AND LIGHT TONER IMAGES

(75) Inventor: Kei Yasutomi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 290 days.

(21) Appl. No.: 11/349,145

(22) Filed: Feb. 8, 2006

(65) Prior Publication Data

US 2006/0188274 A1 Aug. 24, 2006

(30) Foreign Application Priority Data

Feb. 14, 2005 (JP) ..... 2005-035465

(51) Int. Cl.
*G03G 15/08* (2006.01)

(52) U.S. Cl. ..... 399/27

(58) Field of Classification Search ..... 399/27–30, 399/61–65

See application file for complete search history.

(56) References Cited

U.S. PATENT DOCUMENTS

| | | | | |
|---|---|---|---|---|
| 5,740,494 | A | 4/1998 | Shoji et al. | |
| 5,999,773 | A | 12/1999 | Yasutomi et al. | |
| 6,366,751 | B1 | 4/2002 | Shakuto et al. | |
| 6,597,885 | B2 | 7/2003 | Kai et al. | |
| 6,625,409 | B2 | 9/2003 | Shakuto et al. | |
| 6,654,579 | B2 | 11/2003 | Shakuto et al. | |
| 6,757,509 | B2 | 6/2004 | Shoji et al. | |
| 6,778,805 | B2 | 8/2004 | Kai et al. | |
| 6,800,410 | B2 | 10/2004 | Yasutomi et al. | |
| 6,819,901 | B1 | 11/2004 | Yasutomi et al. | |
| 6,978,109 | B2 | 12/2005 | Shoji et al. | |
| 2002/0081128 | A1 | 6/2002 | Shakuto et al. | |
| 2002/0090229 | A1 | 7/2002 | Shakuto et al. | |
| 2006/0029403 | A1 * | 2/2006 | Hirota et al. | 399/27 |
| 2006/0029404 | A1 * | 2/2006 | Hirota et al. | 399/27 |

FOREIGN PATENT DOCUMENTS

| | | |
|---|---|---|
| JP | 8-227213 | 9/1996 |
| JP | 8-305099 | 11/1996 |
| JP | 11-149207 | 6/1999 |
| JP | 2002-49191 | 2/2002 |
| JP | 2002-91165 | 3/2002 |

* cited by examiner

*Primary Examiner*—Ryan Gleitz
(74) *Attorney, Agent, or Firm*—Oblon, Spivak, McClelland, Maier & Neustadt, P.C.

(57) ABSTRACT

An image forming apparatus includes a first and a second developing unit storing dark toner and light toner, respectively, a dark toner and a light toner replenishing device for replenishing the dark toner and light toner to the first and second developing units, respectively, and a toner replenishment control unit storing a dark toner replenishment history and a light toner replenishment history for controlling the operations of the dark toner and light toner replenishing devices. The toner replenishment control unit corrects, when replenishing the light toner, the light toner replenishing operation by referencing the dark toner replenishment history to thereby control the operation of the light toner replenishing device or corrects, when replenishing the dark toner, the dark toner replenishing operation by referencing the light toner replenishment history to thereby control the operation of the dark toner replenishing device.

27 Claims, 15 Drawing Sheets

FIG. 15

| DURATION t OF NON-REPLENISHMENT | RESULT OF DECISION t (LIGHTNESS VARIATION OF OUTPUT IMAGE ) |
|---|---|
| T × 0.0 ( =0.0sec) | × |
| T × 0.05 ( =0.35sec) | × |
| T × 0.10 ( =0.70sec) | × |
| T × 0.15 ( =1.05sec) | △ |
| T × 0.20 ( =1.40sec) | ○ |
| T × 0.25 ( =1.75sec) | ○ |
| T × 0.30 ( =2.10sec) | ○ |
| T × 0.35 ( =2.45sec) | ○ |
| T × 0.40 ( =2.80sec) | ○ |

IMAGE FORMING APPARATUS WITH SUPERIMPOSED DARK AND LIGHT TONER IMAGES

BACKGROUND OF THE INVENTION

1. Field of the Invention

The present invention relates to an image forming apparatus and more particularly to an image forming apparatus of the type forming toner images with dark toner and light toner of substantially the same hue and superposing the toner images on a sheet or recording medium to thereby output an image.

2. Description of the Background Art

It is a common practice with an image forming apparatus of the type forming an image by using a single kind of toner for each hue to attach importance to the density of a solid image. To this end, use is made of toner containing an amount of colorant or pigment great enough to provide a solid image with sufficiently high density. On the other hand, an area tonality scheme has customarily been applied to an electrophotographic apparatus or similar hard copy apparatus, which is configured to form an image on a paper sheet or recording medium, for reproducing a medium-density image or a highlight image.

The area tonality scheme, opposite to a density tonality scheme that varies the density of pixels forming an image, reproduces a medium-density image or a highlight image by reducing the ratio of an area over which toner, or ink in the case of printing, deposits. More specifically, the area tonality scheme is capable of reproducing images lying in the range of from a highlight image to a medium-density image or even a high-density image by reducing the size of a toner deposition area, i.e., the size of dots to such a degree that dots cannot be recognized by eye, so that a person, watching an image, is not aware of the size of the toner deposition area.

Assume that images lying in a range of from a highlight image to a medium-density image are reproduced by the area tonality scheme with toner containing an amount of colorant great enough to implement the desired density of a solid image. This kind of toner will be referred to as dark toner hereinafter. Such a method using dark toner brings about the following problems.

In the case of a highlight image, the dark toner must be evenly deposited on dots in an extremely small amount. However, when it comes to an electrophotographic image forming system that forms a latent image on a photoconductive drum with a laser beam and deposits toner on the latent image for thereby developing it, it is difficult to evenly deposit a small amount of toner on the latent image by accurate control during development. This makes the amounts of toner deposited on dots and therefore image density irregular and therefore, when an image is output by the electrophotographic system using the dark toner, aggravates granularity which is one of important factors determining the quality of the range of from a highlight image to a medium-density image. Granularity of an image itself is well known in the art and will not be described specifically in order to avoid redundancy.

As for the electrophotographic system, granularity cannot be improved in the case of a natural image or similar image whose granularity is critical for the reasons stated above. Consequently, image quality attainable with the electrophotographic system is lower than one attainable with a printing system, an ink jet printing system or similar hard copy system.

Japanese patent laid-open publication No. 2002-91165, for example, discloses an image forming apparatus of the type forming a toner image by repeating development with dark toner and light toner and teaches that a difference in mean amount of charge between the dark toner and the light toner is not greater than 20% or that a difference in weight-mean particle size between the dark toner and the light toner is not greater than 25%. Such a configuration, according to the above document, implements a monochromatic image forming apparatus with a particular relation in characteristic between the dark toner and the light toner that insures a stable monochromatic image with desirable tonality. Also, the above document describes that in the case of a color image forming apparatus using dark toner and light toner for each of colors Y (yellow) C (cyan), M (magenta) and K (black), a particular relation in characteristic between the dark toner and light toner is established that insures color reproducibility and tonality for thereby realizing a stable color image.

Japanese patent laid-open publication No. 11-149207 proposes a system in which the sum of a preselected period of time necessary for the replenishment of a developer and a preselected period of time necessary for suspension is selected to be shorter than a period of time necessary for the operation mode of the shortest operation, and the preselected period of time necessary for the replenishment and the period of time necessary for suspension both end during a single operation mode. The problem with conventional methods in general is that the start-and stop of a drive system are apt to occur during the replenishment of toner. At this instant, the amount of toner replenishment becomes unstable due to the influence of the start-up time of a hopper and the collapse of a heap of toner occurring in a developer conveying section, rendering image density irregular and bringing about fog. The above document describes that the method disclosed therein allows a stable image free from irregular image density and fog to be stably produced at all times.

Japanese patent laid-open publication No. 8-305099 teaches a method that does not replenish, even when a P sensor senses the toner-end condition of a developing unit, toner until image formation ends and then replenishes toner after image formation. It has been customary with conventional methods to drive a toner replenish roller and a sponge roller as soon as the toner end condition of a developing unit is sensed, thereby replenishing toner. This, however, causes image formation and toner replenishment to occur at the same time, so that vibration occurs during the formation of a latent image and disturbs the latent image.

Japanese patent laid-open publication No. 8-227213 discloses an image forming method using toner replenishing means for controlling toner replenishment in accordance with the toner content of a developer sensed and means for sensing the area ratio of a latent image. The image forming method taught in the above document sets the amount of developer replenishment, duration of replenishment and replenishing timing. With this method, according to the above document, it is possible to replenish toner in matching relation to the amount of toner consumed in accordance with image density, thereby insuring stable image density at all times. By contrast, conventional methods have a problem that when images with a great image area ratio and images with a small image area ratio are developed alternately with each other, replenishment cannot catch up with consumption because a certain period of time is necessary for toner replenished to reach a developing sleeve, resulting in an irregular image density distribution.

Japanese patent laid-open publication No. 2002-49191 proposes an image forming apparatus characterized by using dark toner and light toner of substantially the same hue and mainly using the light toner for a range of from a highlight image to a medium image in order to improve granularity. Why such an image forming apparatus improves granularity is presumably that more toner deposits when the light toner is used to form the mesh portion of a highlight image than when the dark toner is used to reproduce a highlight image to a medium-density image. More specifically, the amount of toner for implementing given image density is greater when the light toner is used than when the dark toner is used. Consequently, even when the amount of toner to deposit on the dots of a mesh image increases and is slightly scattered, image density does not noticeably vary. The resulting image is eventually desirable in the aspect of granularity.

However, the image forming apparatus of the type using dark toner and light toner of substantially the same hue as described above has some problems left unsolved, as will be described hereinafter.

Generally, in an image forming apparatus, developing units corresponding in number to the kinds of toners to use are arranged, and each is configured to retain toner and deposits it on a photoconductive drum in accordance with a latent image. Because toner in each developing unit is consumed every time the toner is deposited on a latent image formed on the drum, fresh toner is replenished from a toner replenishing device to the developing unit in such a manner as to maintain the toner content of a developer in the developing unit substantially constant, thereby maintaining image density constant. This can be done by sensing the amount of toner used in the developing unit or directly sensing the toner content of the developer in the developing unit.

When fresh toner is replenished to the developing unit, as stated above, the amount of toner in the developing unit, of course, becomes greater than before the replenishment with the result that the amount of toner to deposit on a given latent image increases. Stated another way, the density of an image to be output varies in accordance with the timing of toner replenishment. Although even a conventional image forming apparatus, in a strict sense, fails to fully prevent image density from varying as a result of toner replenishment, it is used with the variation being confined in a practically acceptable level.

In the image forming apparatus of the type using dark toner and light toner of substantially the same hue to which the present invention pertains, it is necessary to replenish each toner such that the amount of toner in the respective developing unit remains substantially constant. At this instant, the amount of consumption of dark toner and that of light toner is usually not related to each other, so that the time when the dark toner must be replenished and the time when the light toner must be replenished are not related to each other. Consequently, it is likely that the dark toner and light toner are replenished to the respective developing units at the same timing. This brings about the following problem, as determined by experiments.

When the dark toner and light toner are accidentally replenished at the same timing, image density varies between an image output before replenishment and an image output after replenishment more than in a conventional image forming apparatus of the type using a single toner for each hue. Such a difference in the density of an output image is unallowable because it causes a person to feel uncomfortable.

The above problem also arises when dark toner and light toner are used in combination in a color image forming apparatus, e.g., an apparatus loaded with dark magenta toner and light magenta toner, dark cyan toner and light cyan toner or dark yellow toner and light yellow toner. That is, when the dark toner and light toner are accidentally replenished at the same timing, image density or hue varies between an image output before replenishment and an image output after replenishment more than in a conventional image forming apparatus of the type using a single toner for each hue. The colors of the resulting output image critically differ from desired colors.

SUMMARY OF THE INVENTION

It is an object of the present invention to provide an image forming apparatus of the type using the combination of dark toner and light toner and capable of preventing the density of an output image from noticeably varying in relation to the timing of replenishment.

An image forming apparatus of the present invention forms a first toner image with dark toner and a second toner image with light toner and superposes the first and second toner images on a sheet for thereby outputting an image. The image forming apparatus includes a first developing unit storing the dark toner, a dark toner replenishing device for replenishing the dark toner to the first developing unit, a second developing unit storing the light toner, a light toner replenishing device for replenishing the light toner to the second developing unit, a toner replenishment control unit for controlling the operations of the dark-toner and light toner replenishing devices. The toner replenishment control unit stores the replenishment history of the dark toner and corrects, at the time of replenishment of the light toner, a light toner replenishing operation by referencing the replenishment history to thereby control the operation of the light toner replenishing device.

Alternatively, the toner replenishment control unit may be configured to store the replenishment history of the light toner and correct, at the time of replenishment of the dark toner, a dark toner replenishing operation by referencing the replenishment history to thereby control the operation of the dark toner replenishing device.

Further, the toner replenishment control unit may be configured to store both of the replenishment history of the light toner and the replenishment history of the light toner and correct, at the time of replenishment of the light toner, a light toner replenishing operation by referencing the replenishment history of the dark toner to thereby control the operation of the light toner replenishing device or correct, at the time of replenishment of said dark toner, a dark toner replenishing operation by referencing the replenishment history of the light toner to thereby control the operation of the dark toner replenishing device.

BRIEF DESCRIPTION OF THE DRAWINGS

The above and other objects, features and advantages of the present invention will become more apparent from the following detained description taken with the accompanying drawings in which:

FIG. 15 is a table listing the results of experiments conducted to determine how the lightness of an output image varies with respect to a period of time during which toner replenishment is not executed.

DESCRIPTION OF THE PREFERRED EMBODIMENTS

Preferred embodiments of the image forming apparatus in accordance with the present invention will be described hereinafter.

First Embodiment

Figure 1:
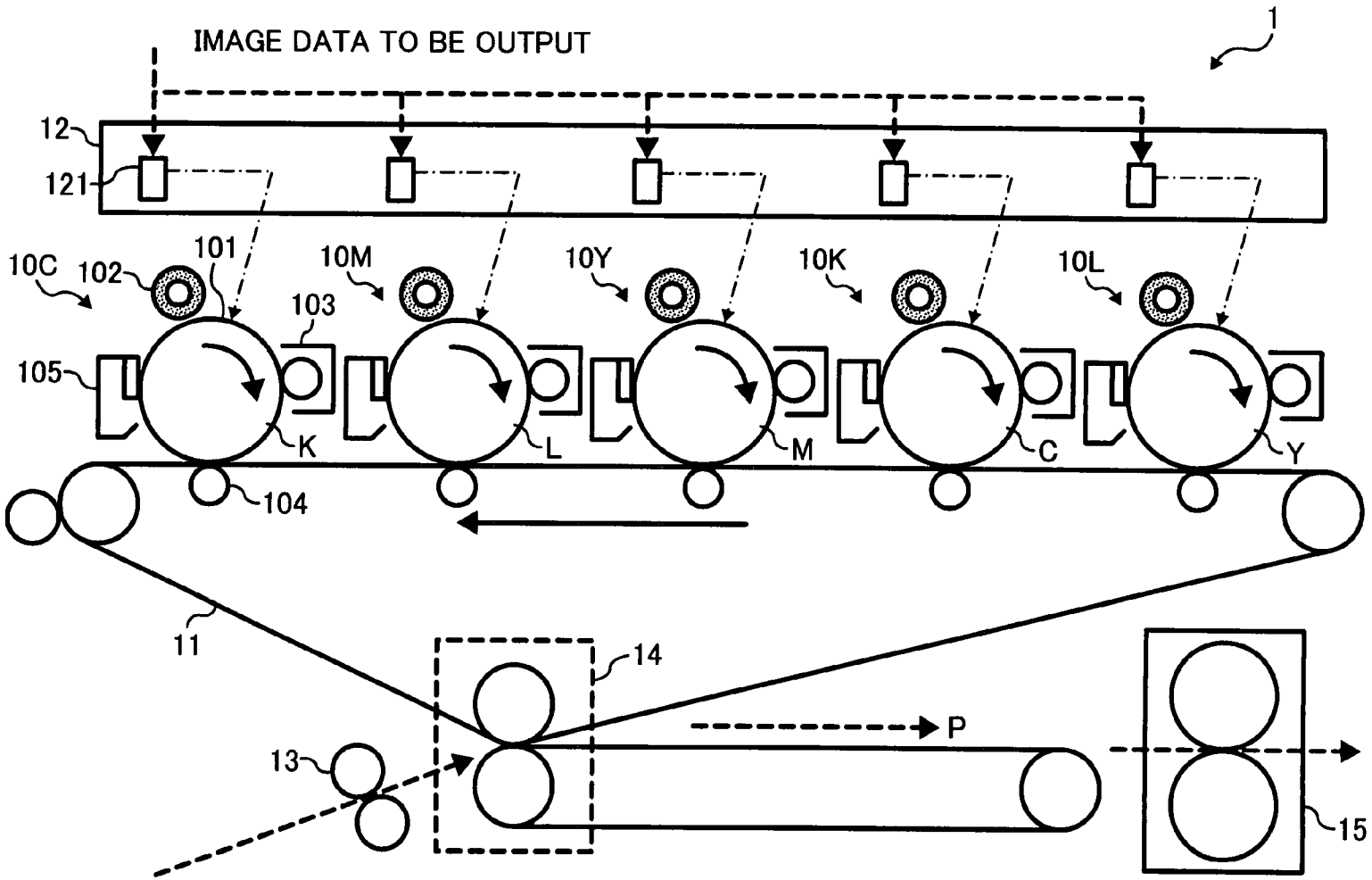
FIG. 1 is a side elevation showing a first embodiment of the image forming apparatus in accordance with the present invention.

Referring to FIG. 1 of the drawings, an image forming apparatus embodying the present invention is shown and generally designated by the reference numeral 1. As shown, the image forming apparatus 1 is configured to form an image by superposing images of five different colors, i.e., cyan (C), magenta (M), yellow (Y), black (K) and light black (L) on a single sheet. In the illustrative embodiment, five image forming units 10C, 10M, 10Y, 10K and 10L are arranged in an array and assigned to the colors C, M, Y, K and L, respectively. Images formed by the image forming units 10C through 10L are sequentially transferred to an intermediate image transfer body 11 held in contact with the image forming units 10C through 10L. In the illustrative embodiment, the intermediate image transfer body 11 is implemented as a belt and will be referred to as an intermediate image transfer belt 11 hereinafter.

More specifically, the intermediate image transfer belt 11 is caused to turn by drive means, not shown, at preselected timing, so that the images of different colors C, M, Y, K and L are superposed on the belt 11 one above the other, forming a composite color image. The color image thus formed on the intermediate image transfer belt 11 is transferred to a paper sheet or similar recording medium.

Because the image forming units 10C through 10L are substantially identical in configuration with each other, let the following description concentrate on the image forming unit 10C by way of example. The image forming unit 10C includes a photoconductive drum (simply drum hereinafter) 101, which is a specific form of a photoconductive element. A charger 102 uniformly charges the surface of the drum 101 to a preselected polarity. A laser optics unit 12 writes image data to be output, i.e., image data undergone pseudo-halftone processing on the charged surface of the drum 101 for thereby forming a latent image. A developing unit 103 develops the latent image thus formed on the drum 101 with C toner. The resulting C toner image is transferred from the drum 101 to the intermediate image transfer belt 11 by an image transferring device or primary image transferring device 104. The toner left on the drum 101 after the primary image transfer is removed by a drum cleaner 105.

A paper sheet or similar sheet P is conveyed from a sheet bank, not shown, to a registration roller pair 13 by conveying means and then conveyed by the remigration roller pair 13 to a secondary image transferring device 14 at preselected timing. The secondary image transferring device 14 transfers the color image from the intermediate image transfer belt 11 to a desired position on the sheet P. After the color image on the sheet P has been fixed by a fixing unit 15 by heat and pressure, the sheet or print P is driven out to print tray not shown.

Toner applied to the illustrative embodiment will be described hereinafter. In the illustrative embodiment, toner was produced by polymerization and provided with a volume-mean particle size of 5.5 μm. The particle size was measured by a particle size analyzer Colter Electronics counter model TA-II available from Colter Electronics Inc. with an aperture of 200 μm. Cyan (C), magenta (M), yellow (Y), black (K) and light black (L) toners were produced by substantially the same method. It should be noted that polymerization is, of course, only illustrative and may be replaced with, e.g., dispersion polymerization or pulverization.

Figure 2:
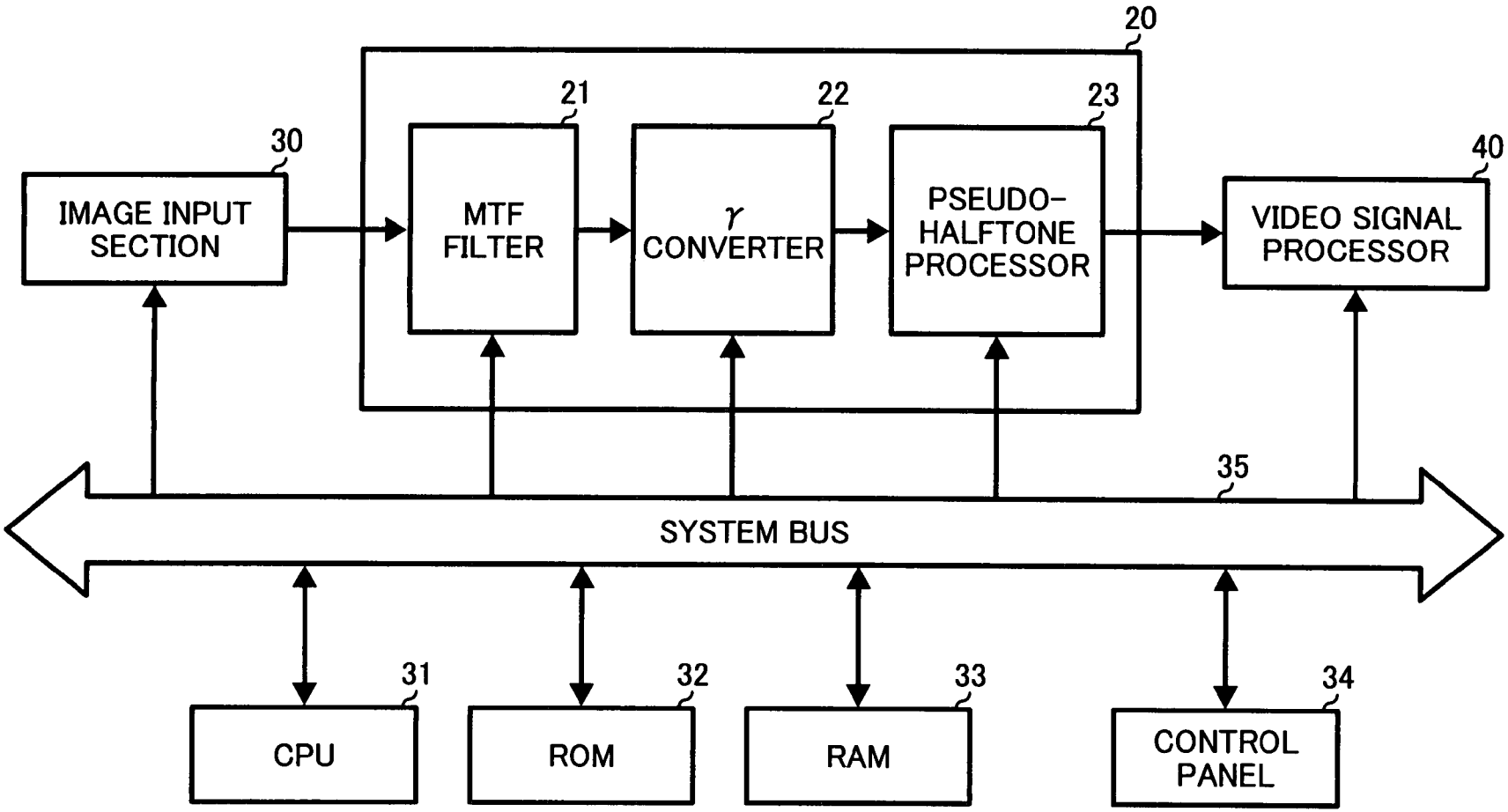
FIG. 2 is a block diagram schematically showing a control system included in the first embodiment.

Reference will be made to FIG. 2 for describing image processing circuitry included in the illustrative embodiment for producing image data to be output from input image data. As shown, data representative of a multi-level (eight bits in many cases) is input to an image processor 20 from a scanner associated with a copier, a personal computer associated with a printer or similar image input section 30. The image data input to the image processor 20 is enhanced by an MTF (Modulation Transfer Function) filter 21 and then subjected to color conversion from an RGB (red, green and blue) color space to a CMYKL color space and density control, which implements preselected tonality, by a γ-conversion controller or tonality corrector 22. The image data thus processed by the image processor 20 is subjected to pseudo-halftone processing by a pseudo-halftone processor 23 to be matched to the printer characteristic thereby and then delivered to an image output side or laser beam modulation driver, not shown, as two-bit image data to be output having a resolution of 1,200 dpi (dots per inch). The MTF filtering, color correction, γ correction and pseudo-halftone processing are conventional and will not be described specifically in order to avoid redundancy.

The circuitry shown in FIG. 2 further includes a CPU (Central Processing Unit) 31, a ROM (Read Only Memory) 32, a RAM (Random Access Memory) 33, a control panel 34 and a system bus 35.

Figure 3:
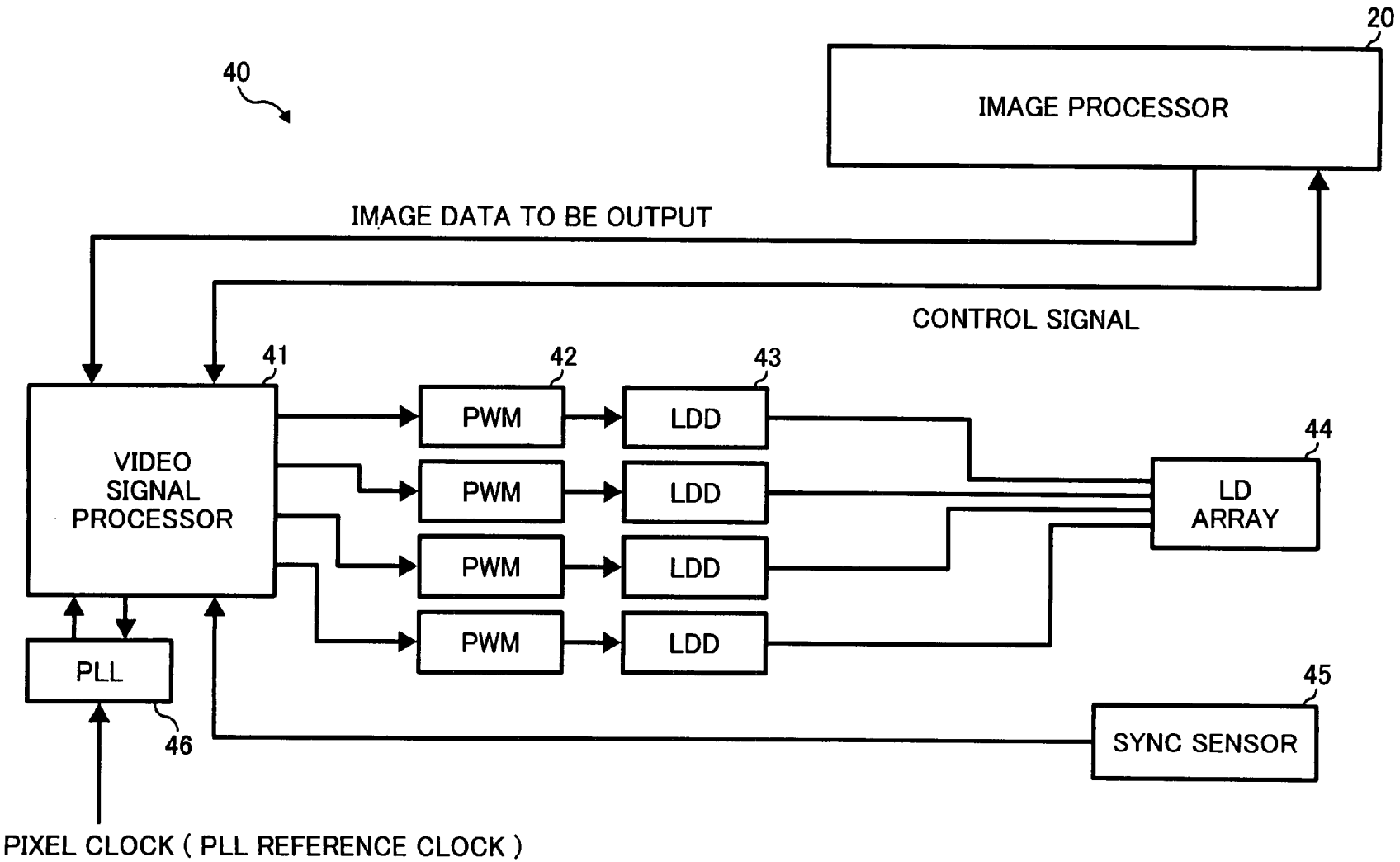
FIG. 3 is a block diagram schematically showing a video signal processor included in the control system of FIG. 2.

The data for an output image processed by the image processor 20 is fed to a video signal processor 40. FIG. 3 is a block diagram schematically showing the flow of data of one color, e.g., K in the video signal processor 40. Because one video signal processor 40 is assigned to each of the other colors C, M, Y and L also and operates in the same manner as the video signal processor 40 of FIG. 3, let the following description concentrate on the flow of data of color K.

As shown in FIG. 3, when the data for an output image, i.e., the result of image processing is input to the video signal processor 40, part of the data corresponding in number to the emission points or laser diodes 121, see FIG. 1, are written in a line memory not shown. Subsequently, the data, thus stored in the line memory and each corresponding to a particular pixel of a video signal processor 41, are transferred to PWM (Pulse Width Modulation controllers 42 in synchronism with a signal synchronous to the rotation of a polygonal mirror and output from a synchronization sensor 45, i.e., a so-called synchronization signal at the timing of a pixel clock fed from a PLL (Phase Locked Loop). In the illustrative embodiment, four emission points are assigned to each color. The PWM controllers 42 each convert the input data to a PWM signal and feed the PWM signal to corresponding one of four LDDs (Laser Diode Drivers) 43. The LDDs 43 drive an LD (Laser Diode) array 44 in accordance with the PWM signals for thereby effecting optical modulation with preselected amounts of light. In the illustrative embodiment, PWM control is executed in correspondence to the five colors of data for an output image.

Laser light, emitted from the LD array 44, is collimated by collimator lenses and then trimmed by apertures to form laser beams having a desired diameter. The light beams, passed through the apertures, are converged by scanning lenses or f-θ lenses, reflected by a mirror and then focused on the photoconductive drum. The present invention mainly relates to replenishment of toner to the developing unit of each image forming unit included in an image forming apparatus of the type described above. Therefore, the construction of the developing unit and a toner replenishing mechanism will be described in detail hereinafter.

Figure 4:
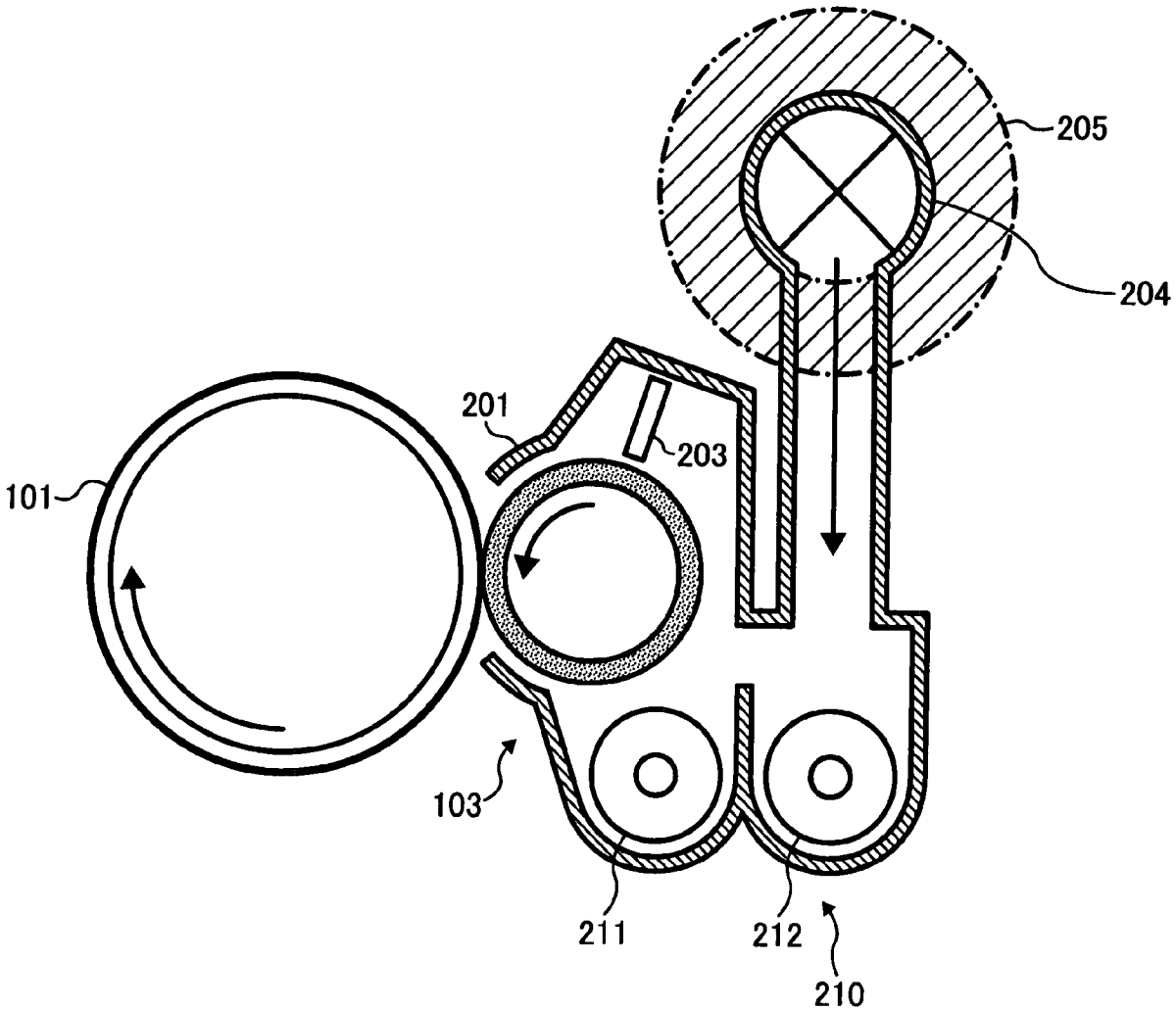
FIG. 4 is a section showing a developing unit included in the first embodiment.

The developing unit 103, FIG. 1, stores a two-ingredient type developer made up of a magnetic carrier and toner stated earlier. As shown in FIG. 4, the developing unit 103 includes a sleeve 201, an agitating member 202 made up of two screws 211 and 212 and a toner replenishing device 204. The sleeve 201 is a hollow, cylindrical member formed of a nonmagnetic material and having a rotatable surface and causes the developer to deposit thereon and form a magnet brush. A conventional magnet roller, implemented by permanent magnets, are disposed in the sleeve 201, although not shown specifically. The screws 211 and 212 agitate the developer stored in the developing unit 103 to thereby charge it to a preselected amount of charge. The toner replenishing device 204 is configured to replenish fresh toner stored in a toner bottle or toner container 205 to the developer existing in the developing unit 103. The reference numeral 203 designates a doctor blade for regulating the thickness of the developer forming a layer on the sleeve 201.

More specifically, the toner replenishing device 204 includes a rotatable feed member held in contact with the mouth of the toner bottle 205. A control unit, which will be described specifically later, causes the feed member to rotate for producing a preselected amount of fresh toner from the toner bottle 205 and replenishing it to the developer stored in the developing unit 103. The toner thus produced from the toner bottle 205 drops into the developing unit 103, as indicated by an arrow in FIG. 4.

Figure 5:
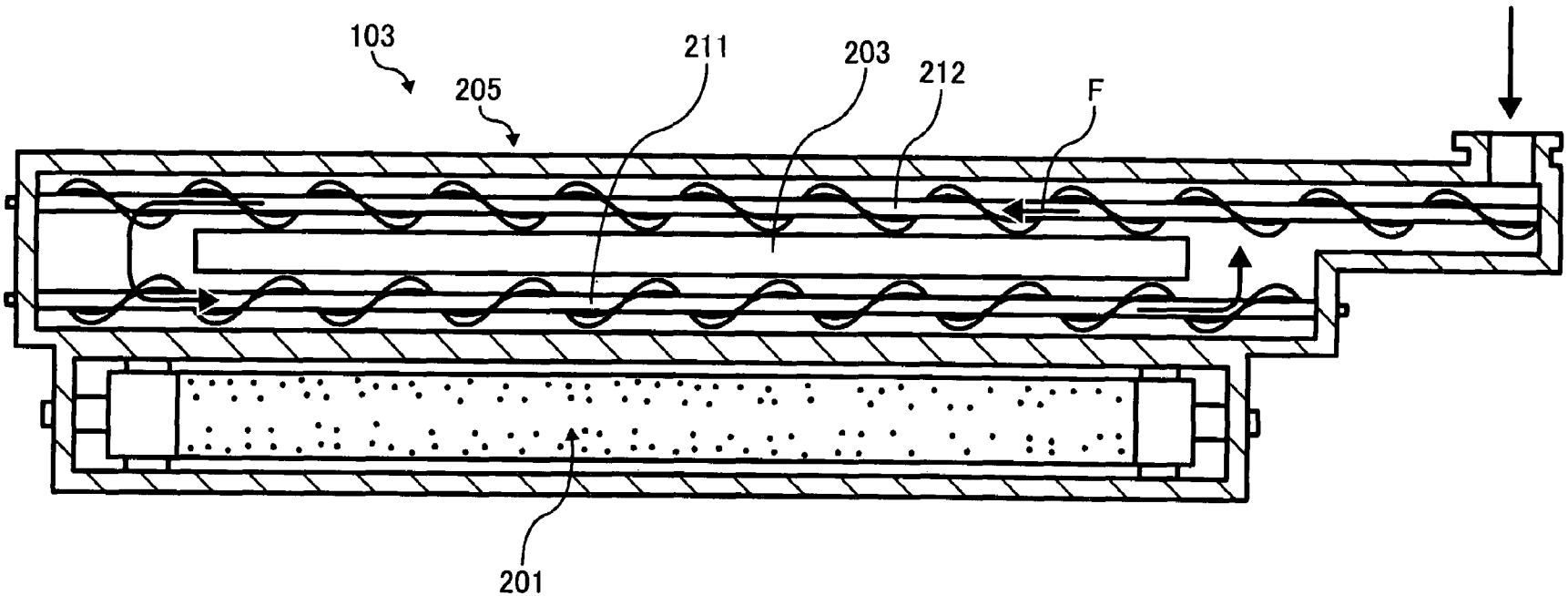
FIG. 5 is a plan view showing the developing unit.

The agitating section of the developing unit 103 will be described more specifically with reference to FIG. 5. As shown, the screws 211 and 212, constituting the agitating member 202 in combination, are caused to rotate in opposite directions to each other so as to convey the developer in opposite directions. The screw 212 remote from the sleeve 202 and the screw 211 close to the sleeve 202 will hereinafter be referred to as a replenishment screw 212 and a development screw 211, respectively.

The toner replenished via a toner replenishing position is conveyed to the other end of the replenishing position in the axial direction of the development screw 211. The inside of the developing unit 103 is divided by a partition 203, so that the replenishment screw 212 and development screw 211 are isolated from each other. Opposite end portions of the partition 203 in the lengthwise direction are cut off in parallel with the axial direction of the screws 211 and 212, providing communication between a space accommodating the screw 211 and a space accommodating the screw 212.

In the configuration stated above, the fresh toner replenished from the toner bottle 205 is first conveyed by the replenishment screw 212 away from the toner replenishing position and then mixed with the developer existing in the developing unit 103. On reaching a position where the partition 203 is cut off, the developer, containing the fresh toner and agitated by the replenishment screw 212, is introduced into the space accommodating the development screw 211 via the above position. The development screw 211 conveys the developer mixture in the axial direction of the sleeve 201 while agitating it. In FIG. 5, the developer is shown as being circulated in the counterclockwise direction.

The development screw 211, facing the sleeve 201, allows the agitated developer to deposit on the circumferential surface of the sleeve 201. In this condition, the sleeve 201 in rotation conveys the developer to a position where the sleeve 201 faces the drum 101, so that the developer develops a latent image, as stated previously.

In the developing unit 103, the toner contained in the developer is consumed by the development of latent images sequentially formed on the drum 101. Therefore, unless an adequate amount of toner is replenished to the developer, the toner content of the developer decreases with the elapse of time and eventually fails to maintain a preselected image density. In the illustrative embodiment, whether or not the replenishment of fresh toner is necessary is determined by sensing the toner content of the developer. In the illustrative embodiment, the toner content of the developer is determined by measuring the variation of inductance of a sense coil, not shown, disposed in the developing unit 103. More specifically, the toner content of the developer is determined on the basis of the fact that the permeability of the developer varies in accordance with the mixture ratio of carrier mainly constituted by a magnetic material and the toner mainly constituted by resin.

In the illustrative embodiment, a toner content sensor with the above configuration is disposed in each of the C, M, Y, K and L developing units. Toner contents sensed by such toner content sensors are sent to a toner replenishment control unit, which will be described hereinafter, in the form of voltages.

Figure 6:
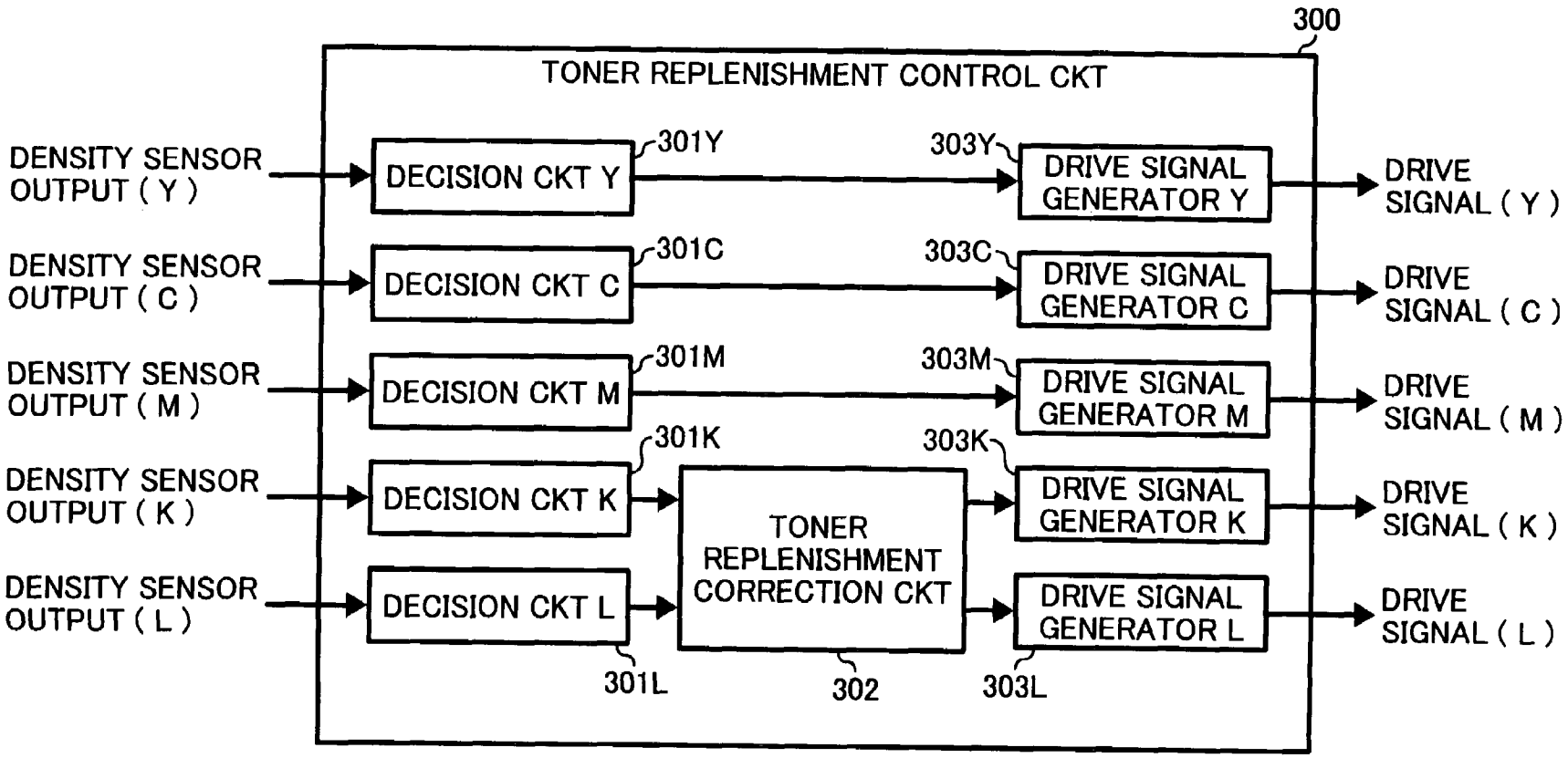
FIG. 6 is a schematic block diagram showing a toner replenishment control unit included in the first embodiment.

FIG. 6 shows a specific configuration of the toner replenishment control unit configured to control, in the illustrative embodiment, all of the C, M, Y, K and L toner replenishing devices. As shown, the toner replenishment control unit, generally 300, includes decision circuits 301Y, 301C, 301M, 301K and 301L each for determining whether or not toner replenishment is necessary in accordance with the output of the associated toner content sensor and drive signal generators 303Y, 303C, 303M, 303K and 303L each for generating a drive signal for driving the associated toner replenishing device. In addition, a toner replenishment correction circuit 302 is assigned to the dark toner K and light toner L. Because the decision circuits 301Y through 301L and drive signal generators 303Y through 303L each are identical in operation, the following description will concentrate on operations executed with one of the five colors.

A specific operation of any one of the decision circuits 301Y through 301L will be described with reference to FIG. 7. As shown, on receiving a voltage $V_{TC}$ representative of a toner content from the toner content sensor (step S101), the decision circuit determines whether or not the voltage $V_{TC}$ is lower than a preselected voltage V0. If the voltage $V_{TC}$ is lower than the voltage V0 (YES, step S102), the decision circuit inhibits toner replenishment (step S103) and repeats the above decision on the elapse of a period of time T1 (step S104). If the voltage $V_{TC}$ is higher than the voltage V0 inclusive, but below another. preselected voltage V1 (YES, step S105), then the decision circuit sends a signal indicative of the replenishment of a small amount of toner L to the drive signal generator associated therewith (step S106). After the step S106, a toner content is again sensed in a preselected period of time T2 in which toner thus replenished is considered to be sufficiently mixed with the developer (step S110).

On the other hand, if the voltage $V_{TC}$ received from the toner content sensor is above the voltage V1 inclusive, but below another preselected voltage V2 (YES, step S107), then the decision circuit sends a signal indicative of the replenishment of a medium amount of toner M to the drive signal generator (step S108). The step S108 is also followed by the step S110. Further, if the voltage $V_{TC}$ is above the voltage V2 inclusive (NO, step S107), then the decision circuit sends a signal indicative of the replenishment of a great amount of toner H to the drive signal generator (step S109) The step S109 is also followed by the step S110.

In the illustrative embodiment, the periods of time T1 and T2 are selected to be 10 seconds and 30 seconds, respectively, although they should preferably be suitably selected in accordance with the actual size of the developing unit and the circulation rate of the developer in the developing unit. The preselected voltages V0, V1 and V2 are, of course, only illustrative because they are dependent on, e.g., the sensitivity of the toner content sensor, i.e., the absolute value of the sensor output is almost meaningless.

Figure 7:
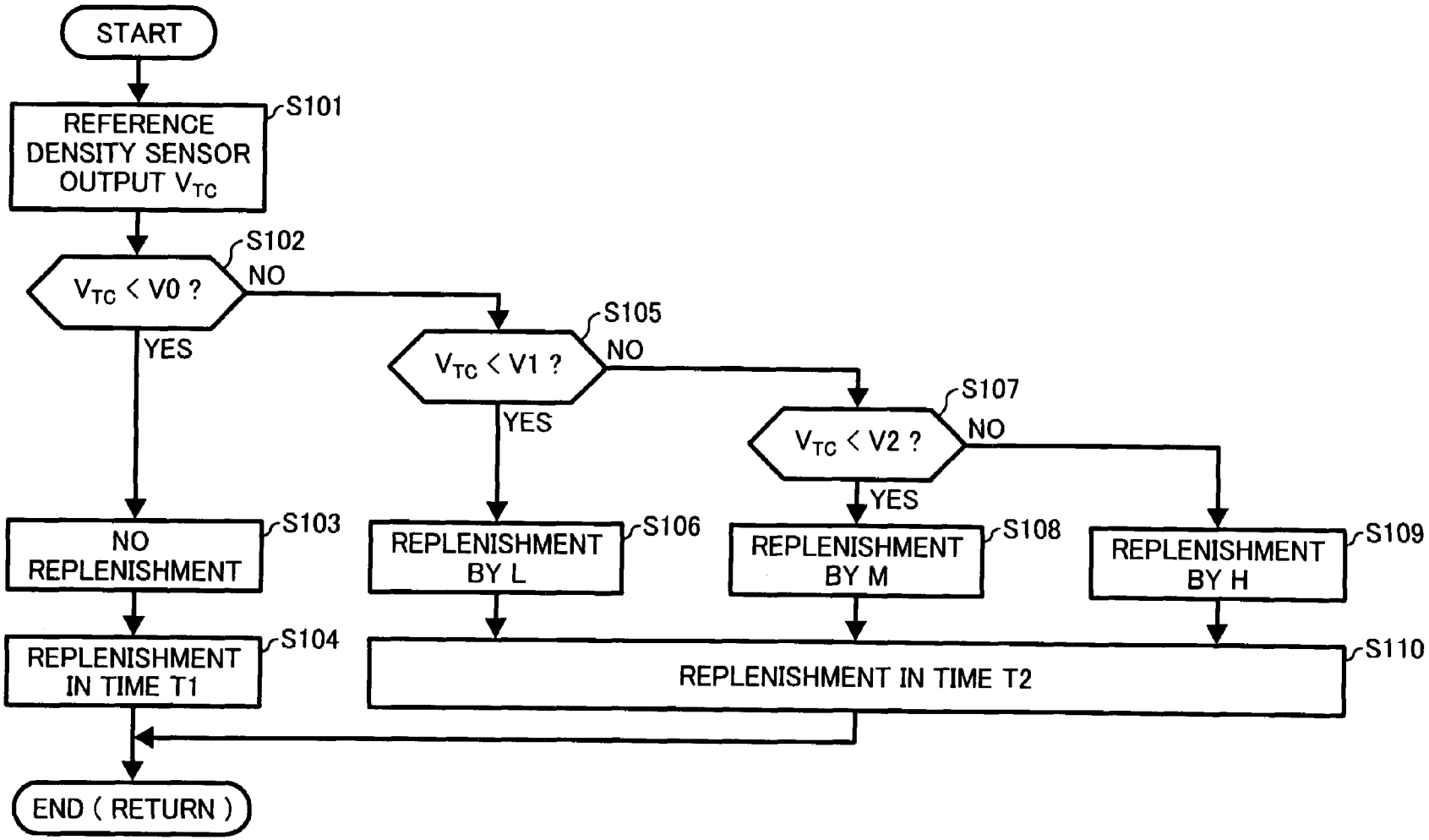
FIG. 7 is a flowchart demonstrating a specific operation of a decision circuit included in the toner replenishment control unit of FIG. 6.

When the signal indicative of toner replenishment is fed from the decision circuit to the drive signal generator in any one of the steps S106, S108 and S109 of FIG. 7, the drive signal generator generates a drive signal for driving the toner replenishing device associated therewith. In response, the drive signal causes the feed member of the toner replenishing device to rotate so as to replenish fresh toner from the toner bottle to the developing unit. In the illustrative embodiment, the drive signal output from the drive signal generator is indicative of the amount of replenishment L, M or H in terms of the duration of drive of the toner replenishing device which is short, medium or long, respectively. In the illustrative embodiment, the amounts of replenishment L, M and H are selected to be 2 grams, 4 grams and 6 grams, respectively, for 350 grams of developer by way of example.

In the illustrative embodiment, toner replenishment to the developing unit is executed in exactly the same manner, i.e., by the decision on replenishment by the decision circuit and then generation of a drive signal for three colors C, M and Y. On the other hand, as for black K and light black L, the toner replenishment correction circuit 302 is connected between the decision circuits 301K and 301L and the drive signal generators 303K and 303L, as shown in FIG. 6, in order to implement K toner and L toner by correction.

More specifically, in the illustrative embodiment, the time for replenishing toner is controlled between the K toner and the L toner which are of substantially the same hue, as will be described hereinafter.

Figure 8:
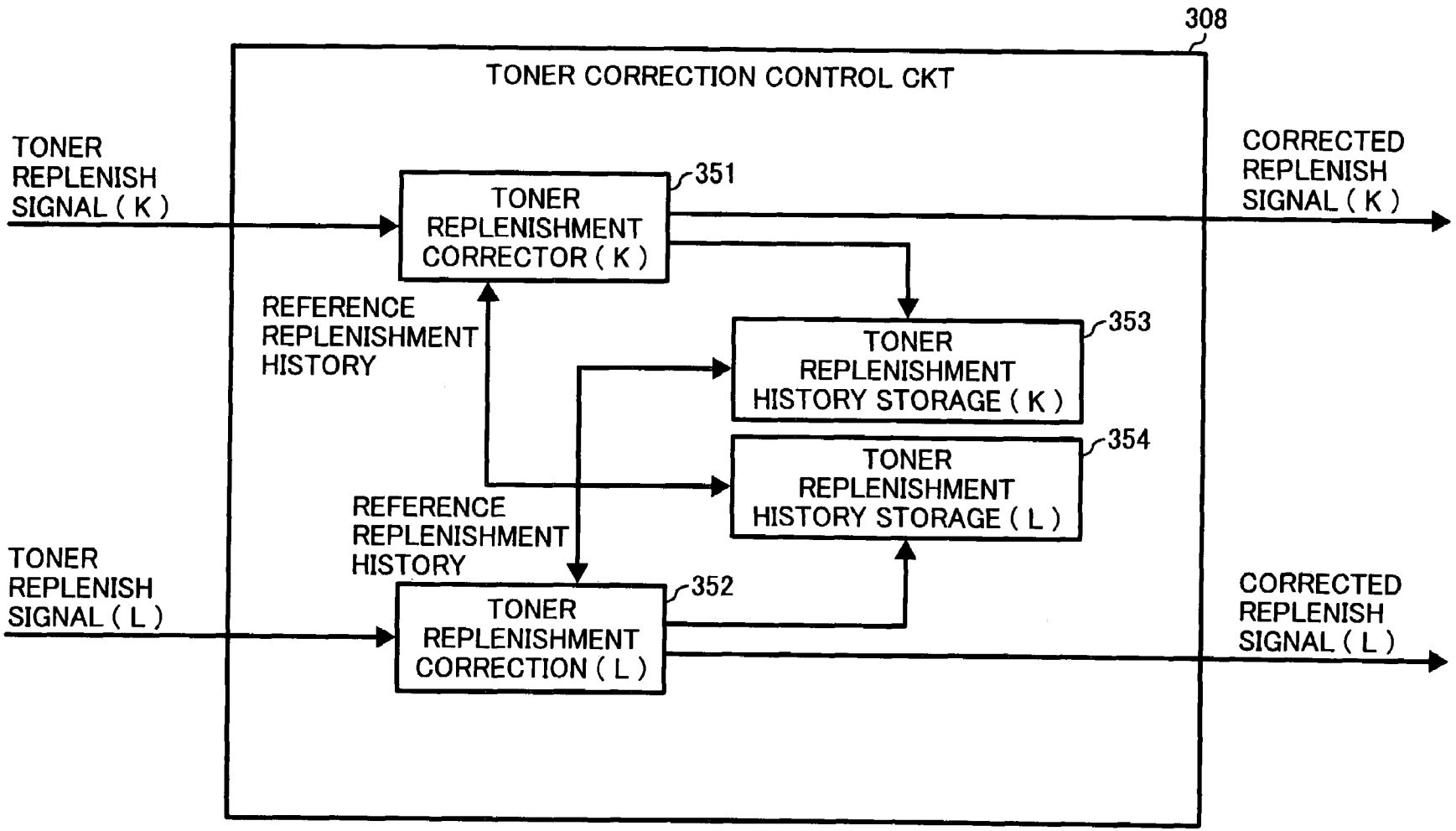
FIG. 8 is a schematic block diagram showing a toner replenishment correction circuit also included in the toner replenishment control unit of FIG. 6.

FIG. 8 is a block diagram schematically showing the toner replenishment correction circuit 302 included in the toner replenishment control unit 300. As shown, if the K toner or the L toner must be replenished, as determined by the decision circuit 301K or 301L, respectively, then a replenish signal is input to the toner replenishment correction circuit 302. More specifically, a K and an L toner replenish signal are input to a K and an L toner replenishment timing corrector 351 and 352, respectively. In response to the K toner replenish signal, the K toner replenishment timing corrector 351 corrects the time for replenishing toner, as follows.

To correct the time for replenishing K toner, the K toner replenishment timing corrector 351 determines whether or not a preselected period of time has elapsed since the last replenishment of L toner by referencing an L replenishment history storage 354. If the answer of this decision is positive, the K toner replenishment timing corrector 351 replenishes K toner as usual. However, if the answer of the above decision is negative, the K toner replenishment timing corrector 351 does not execute the replenishment of K toner until the preselected period of time elapses, and then writes the K toner replenishment history in a K replenishment history storage 353 after the replenishment.

On the other hand, by referencing the K replenishment history storage 353, the L toner replenishment timing corrector 352 determines whether or not a preselected period of time has elapsed since the last replenishment of K toner. If the answer of this decision is positive, the L toner replenishment timing corrector 352 replenishes L toner as usual. However, if the answer of the above decision is negative, the K toner replenishment timing corrector 352 does not execute the replenishment of L toner until the preselected period of time elapses, and then writes the L toner replenishment history in the L replenishment history storage 354.

In the illustrative embodiment, it is necessary for the toner replenishment control unit 300 to store at least one time of past replenishment as a history with each of K toner and L toner. For this purpose, in the illustrative embodiment, the K and L replenishment histories each are written in a particular memory and processed by the CPU. Alternatively, use may be made of a more simple circuit so long as it can determine the time of the last replenishment for thereby delaying the time for replenishing K or L toner by a preselected period of time, as needed.

In the illustrative embodiment, the preselected period of time by which the replenishment of L toner is delayed is selected to be 2 seconds. Experiments showed that when the above preselected period of time was longer than 1.0 second inclusive, the adverse influence of the coincidence of the timings for replenishing toners of the same hue, as described in detail in relation to the background art, was reduced. Further, such an adverse influence did not occur at all when the preselected period of time was longer than 1.4 seconds inclusive. However, it should be noted that the specific period of time stated above is only illustrative.

It is difficult to describe the preselected period of time specifically because it is related to a period of time necessary for the developer in the developing unit to be fully circulated. However, it was experimentally found that assuming that the circulation time of the developer in the developing unit was T, the preselected period of time should preferably be 20% of T, i.e., 0.2T. In this connection, the circulation time of the developer in the illustrative embodiment was 7 seconds. The results of experiments, conducted by varying the preselected period of time, will be described specifically later with reference to FIG. 15.

Second Embodiment

A second embodiment of the image forming apparatus in accordance with the present invention will be described with reference to FIG. 9. The second embodiment is essentially similar to the first embodiment except for the operation of the toner replenishment correction circuit included in the toner replenishment control unit 300, as will be described hereinafter.

Figure 9:
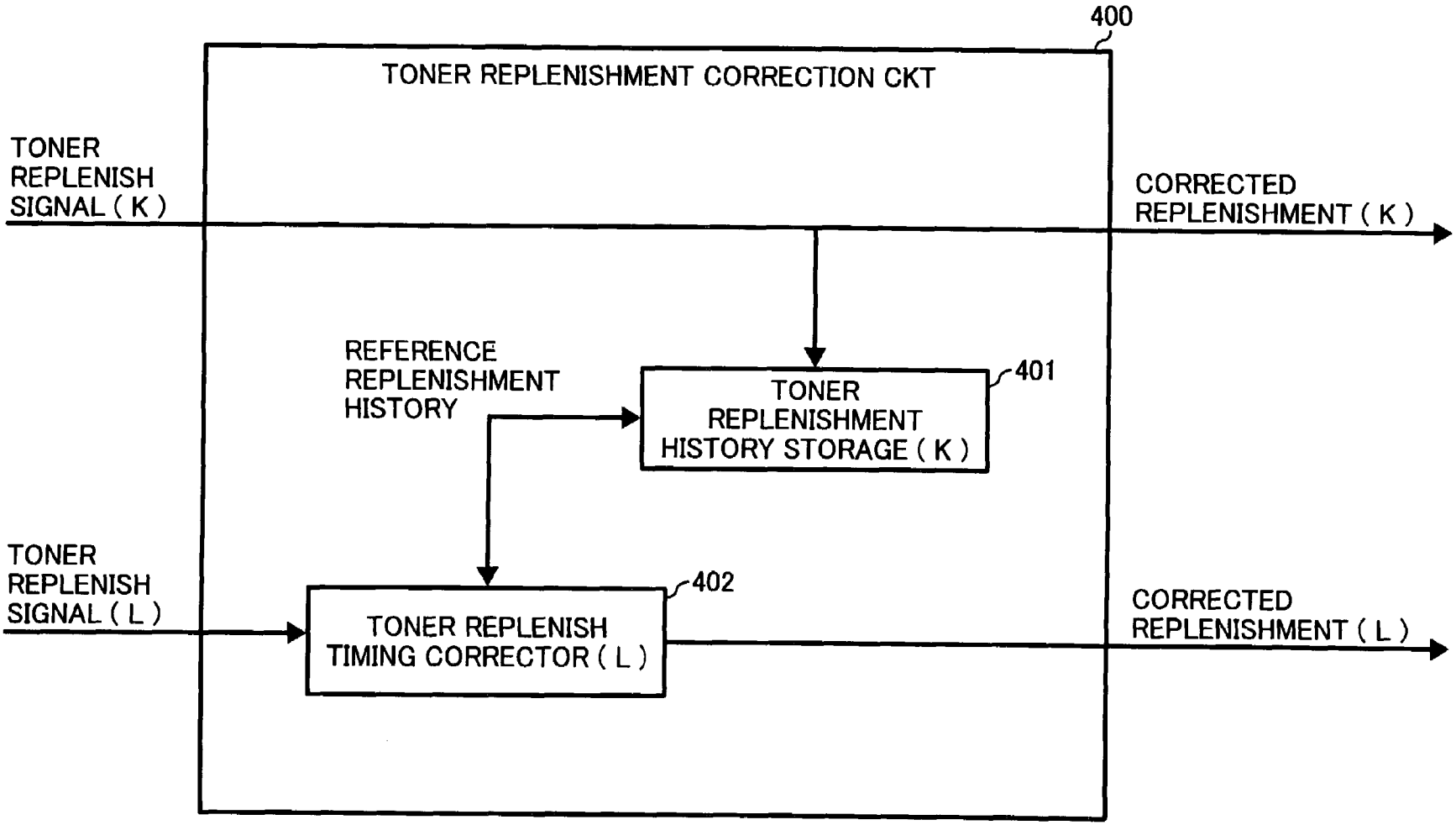
FIG. 9 is a schematic block diagram showing a toner replenishment correction circuit representative of a second embodiment of the present invention.

As shown in FIG. 9, a toner replenishment correction circuit, generally 400, is connected between the decision circuits 301K and 301L, FIG. 6, and the drive signal generators 303L and 303K, FIG. 6 in order to correct the operation of the toner replenishing device. In practice, the illustrative embodiment adjusts the time for replenishment between the K toner and L toner which are of the same hue, as follows. The decision circuits 301K and 301L each determine whether or not the K toner or the L toner, respectively, should be replenished as in the first embodiment and, if the answer of the decision is positive, send a K or an L replenish signal to the toner replenishment correction circuit 400, as illustrated.

In response to the K replenish signal, the toner replenishment correction circuit 400 replenishes K toner as usual and stores the K toner replenishment history in a K replenishment history storage 401. On the other hand, on receiving the L replenish signal, a toner replenishment correction circuit 402 references the replenishment history storage 401 to determine whether or not a preselected period of time has elapsed since the last replenishment of K toner. If the answer of this decision is positive, the toner replenishment correction circuit 402 replenishes L toner as usual. However, if the answer of the above decision is negative, the toner replenishment correction circuit 402 does not effect the replenishment of L toner until the preselected period of time elapses.

The illustrative embodiment described above is capable of coping with the problem ascribable to the coincidence of black toner and light black toner replenishment timings with a simple circuit configuration.

Third Embodiment

A third embodiment of the image forming apparatus in accordance with the present invention will be described with reference to FIG. 10. The third embodiment is essentially similar to the first embodiment except for the operation of the toner replenishment correction circuit included in the replenishment control unit 300, as will be described hereinafter.

Figure 10:
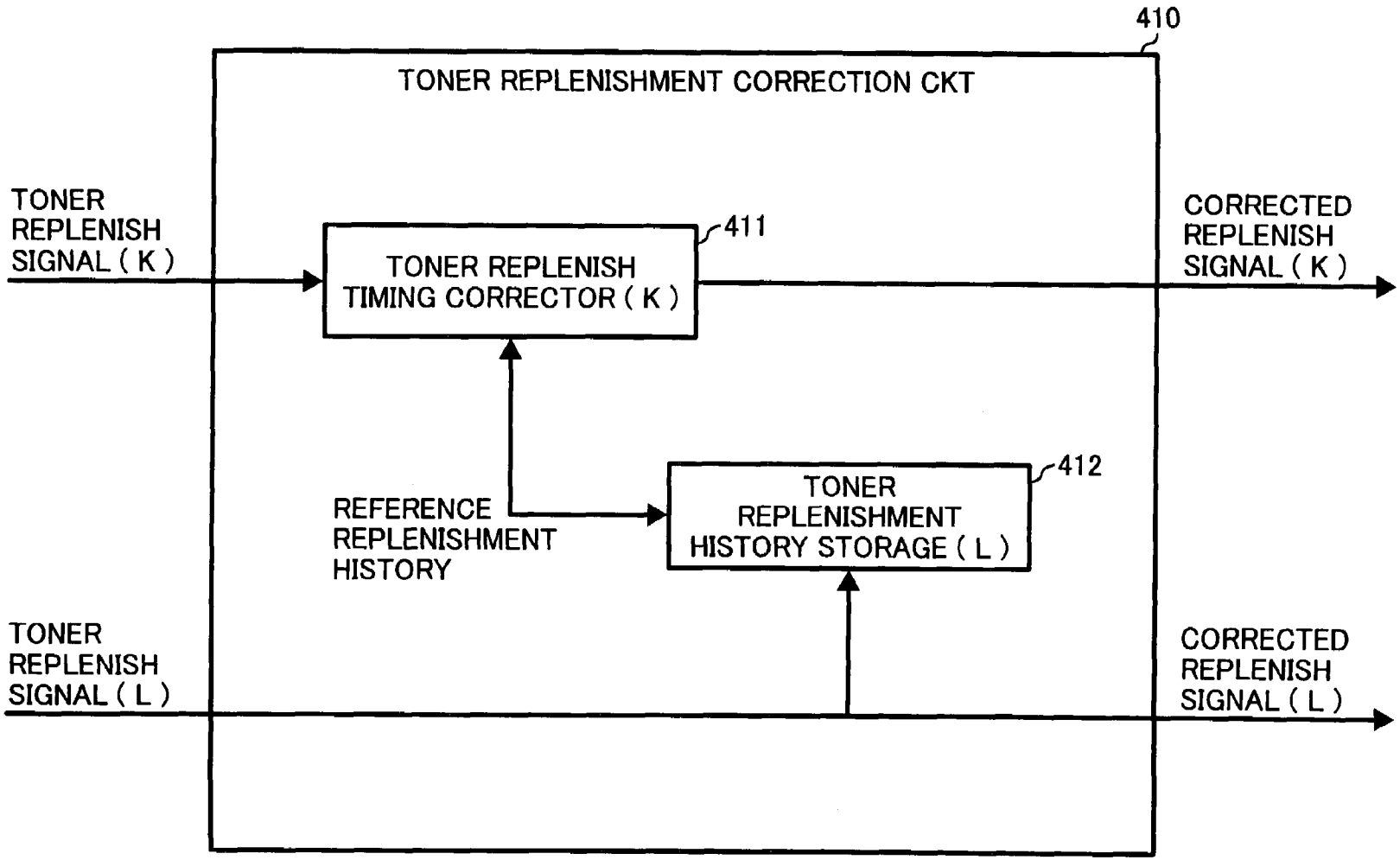
FIG. 10 is a schematic block diagram showing a toner replenishment correction circuit representative of a third embodiment of the present invention.

As shown in FIG. 10, a toner replenishment correction circuit, generally 410, is connected between the decision circuits 301K and 301L, FIG. 6, and the drive signal generators 303L and 303K, FIG. 6 in order to correct the operation of the toner replenishing device. In practice, the illustrative embodiment adjusts the time for replenishment between the K toner and L toner which are of the same hue, as follows. The decision circuits 301K and 301L each determine whether or not the K toner or the L toner, respectively, should be replenished as in the first embodiment and, if the answer of the decision is positive, send a K or an L replenish signal to the toner replenishment correction circuit 410, as illustrated.

In response to the K replenish signal, a toner replenishment corrector 411 included in the correction circuit 410 executes the following correction and sends the resulting toner replenish signal to the drive signal generator 303K, FIG. 6. For the correction, the toner replenishment corrector 411 references an L toner replenishment history storage 412 to determine whether or not a preselected period of time has elapsed since the last replenishment of L toner. If the answer of this decision is positive, the toner replenishment corrector 411 executes the replenishment of K toner as usual. If the answer of the above decision is negative, the toner replenishment corrector 411 does not execute the replenishment of K toner until the preselected period of time elapses.

On the other hand, on receiving the L toner replenish signal, the toner replenishment correction circuit 410 replenishes L toner as usual and writes the replenishment of L toner in the L toner replenishment history storage 412.

The illustrative embodiment described above is also capable of coping with the problem ascribable to the coincidence of black toner and light black toner replenishment timings with a simple circuit configuration.

Fourth Embodiment

A fourth embodiment of the image forming apparatus in accordance with the present invention will be described hereinafter. The fourth embodiment is essentially similar to the first embodiment except for the operation of the toner replenishment correction circuit included in the replenishment control unit 300, FIG. 6. As for the replenishment of, e.g., K toner, the first embodiment references the replenishment history of L toner and replenishes, if a preselected period of time has elapsed since the last replenishment of L toner, K toner as usual, but if otherwise, does not replenish K toner until the preselected period of time elapses.

By contrast, as for the replenishment of K toner, the illustrative embodiment references, the replenishment history of L toner and replenishes, if a preselected period of time has elapsed since the last replenishment of L toner, K toner as usual, i.e., replenishes L toner by the small or L, medium or M or great or H amount as determined by the decision circuit. However, if the answer of the above decision is negative, the illustrative embodiment replenishes a small amount of K toner. In this manner, while the first embodiment corrects the replenishment of toner by delaying the replenishing time, the illustrative embodiment executes the correction by varying the amount of toner to be replenished.

Fifth Embodiment

A fifth embodiment of the image forming apparatus in accordance with the present invention will be described hereinafter. The fifth embodiment differs from the first embodiment in that it controls toner replenishment in accordance with the output of an optical reflectance sensor. Toner replenishment effected in the first embodiment is based on the output a toner content sensor, as stated previously.

A reflectance sensor is made up of a light-emitting device and a light-sensitive device and configured such that when light emitted from the light-emitting device is incident on an object, the resulting reflection from the object is incident on the light-sensitive device, thereby sensing the reflectance of the object.

More specifically, reflection sensors are positioned to face the intermediate image transfer belt 11, FIG. 1, and each read the reflectance of a K toner image or that of an L toner image formed in the non-image area of the belt 11, so that the amounts of toner deposited on the belt 11 can be determined in terms of reflectance. It follows that by executing toner replenishment control on the basis of the outputs of the reflection sensors, it is also possible to maintain the amount of tone deposition constant for thereby insuring images with stable density.

Sixth Embodiment

A sixth embodiment of the image forming apparatus in accordance with the present invention will be described hereinafter. The sixth embodiment differs from the first embodiment in that it controls toner replenishment in accordance with the output of a pixel counter. More specifically, the pixel counter counts, with each of the colors C, M, Y, K and L, pixels at which an optical image is written and then outputs a value proportional to the total number of such pixels. The amounts of toners to be consumed during development can be estimated to a certain degree on the basis of the total number of the above pixels.

The illustrative embodiment compares the output of each pixel counter with a preselected value stored in the toner replenishment control unit in the same manner as in the decision step of the first embodiment, FIG. 7. As for the steps following the decision step, the illustrative embodiment is identical with the first embodiment.

Seventh Embodiment

Figure 11:
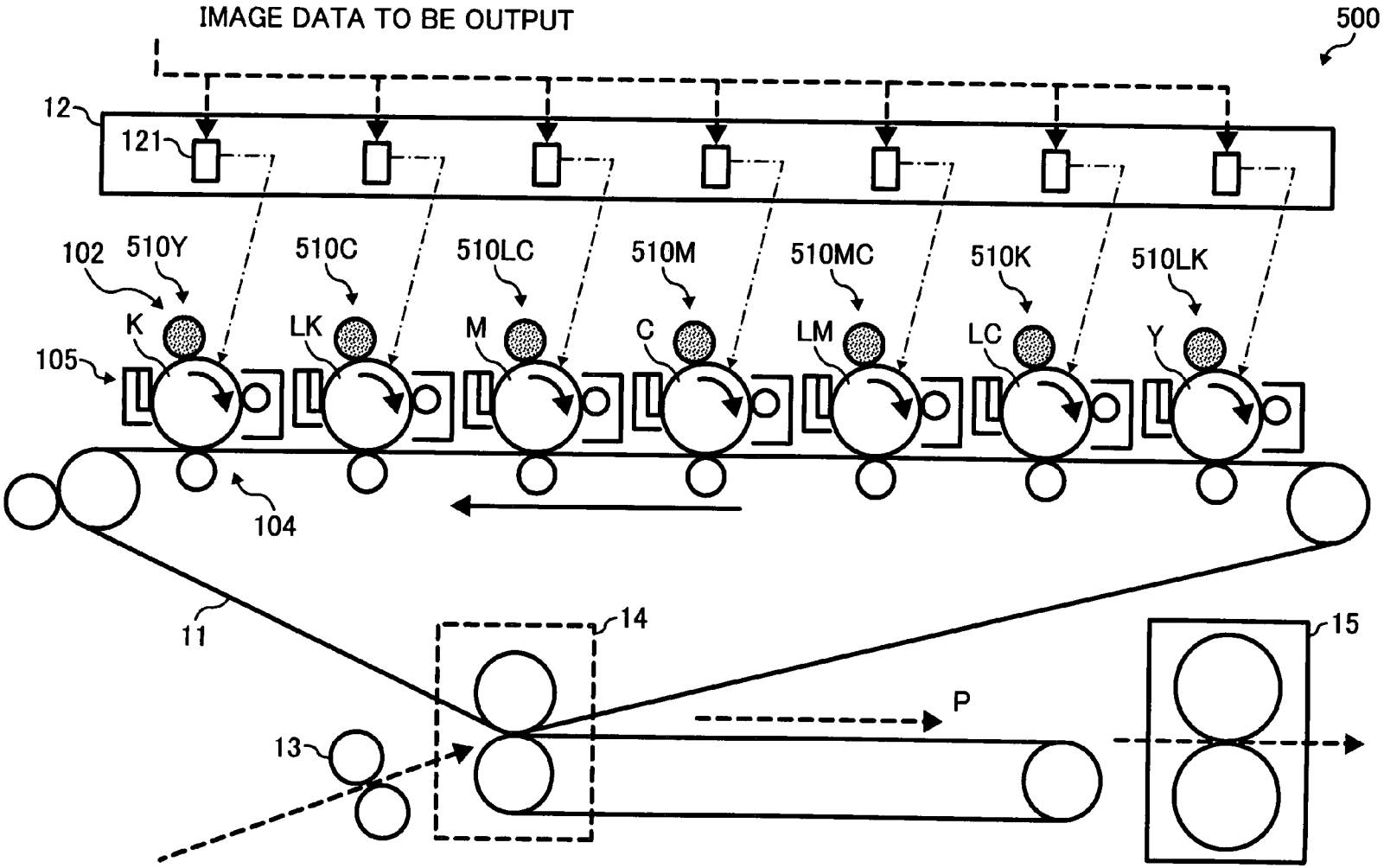
FIG. 11 is a side elevation showing a seventh embodiment of the present invention.

Reference will be made to FIG. 11 for describing a seventh embodiment of the image forming apparatus in accordance with the present invention. As shown, the image forming apparatus, generally 500, is configured to superpose a Y toner image, a C toner image, an LC (light cyan) toner image, an M toner image, an LM (light magenta) toner image, a K toner image and an LK toner image on a single sheet P. For this purpose, seven image forming units 510Y, 510C, 510LC, 510M, 510LM, 510K and 510LK are arranged side by side. The image forming units 510Y through 510LK each are identical in configuration with each image forming unit of the first embodiment, and detailed description thereof will not be made in order to avoid redundancy.

Figure 12:
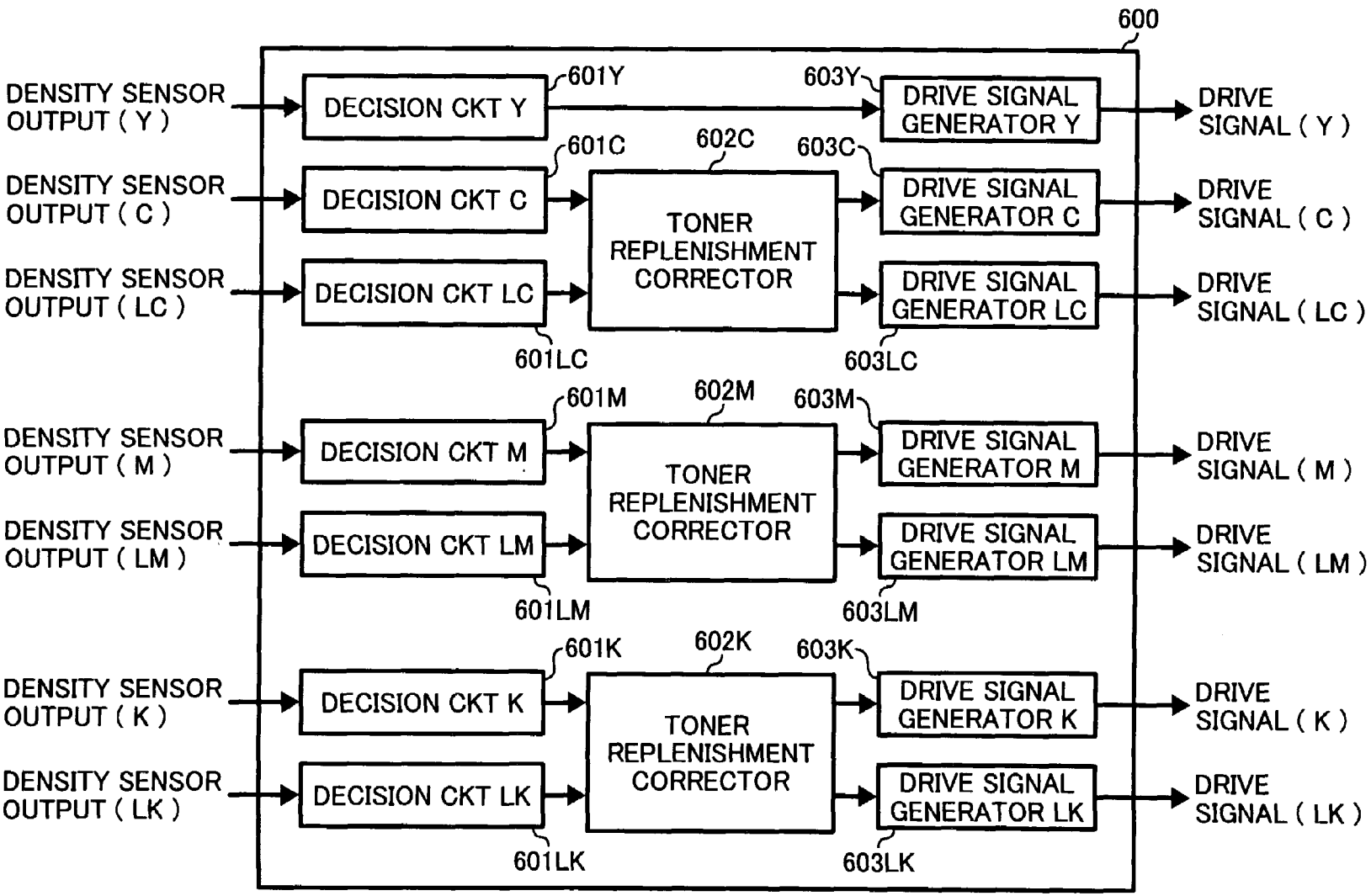
FIG. 12 is a block diagram schematically showing a toner replenishment control unit included in the seventh embodiment.

FIG. 12 shows a toner replenishment control unit 600 included in the image forming apparatus 500 using toners of seven different colors. As shown, a toner replenishment correction circuit 602C is connected between a C and an LC decision circuit 601C and 601LC, respectively, and a C and an LC drive signal generator 603L and 603LC, respectively. Likewise, a toner replenish correction circuit 602M is connected between an M and an LM decision circuit 501M and 501LM, respectively and an M and an LM drive signal generator 603M and 603LM, respectively. Further, a toner replenishment control circuit 602K is connected between a K and an LK decision circuit 601K and 601LK, respectively, and a K and an LK drive signal generator 603K and 603LK, respectively. The toner replenishment correction circuits 602C, 602M and 602K each execute the same correction procedure as in the first embodiment for thereby controlling the replenishment of two toners of the same hue. More specifically, each of the toner replenishment correction circuits 602C, 602M and 602K adequately delays the time for replenishing the dark toner or the light toner in order to prevent the two toners from being replenished at the same time.

Eighth Embodiment

Figure 13:
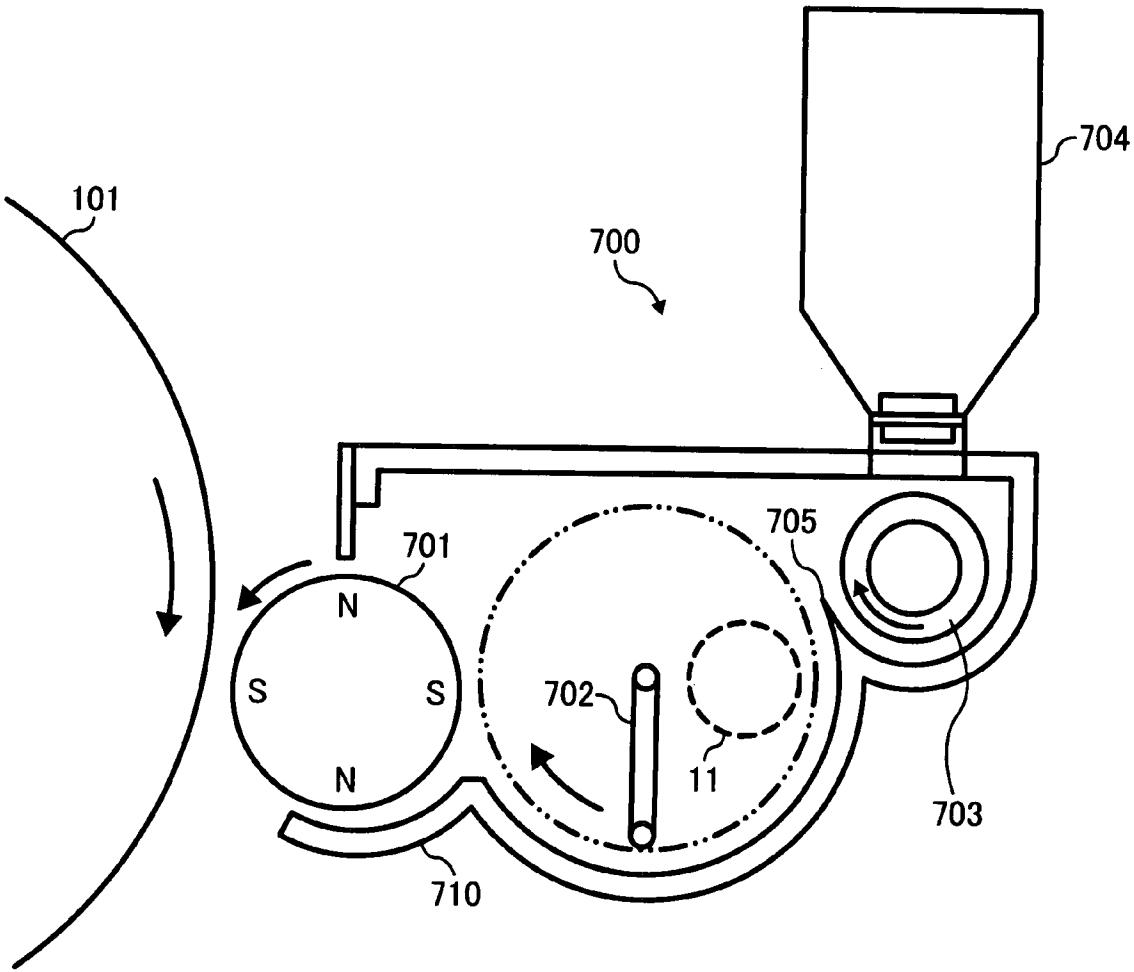
FIG. 13 is a section showing a developing unit representative of an eighth embodiment of the present invention.
Figure 14:
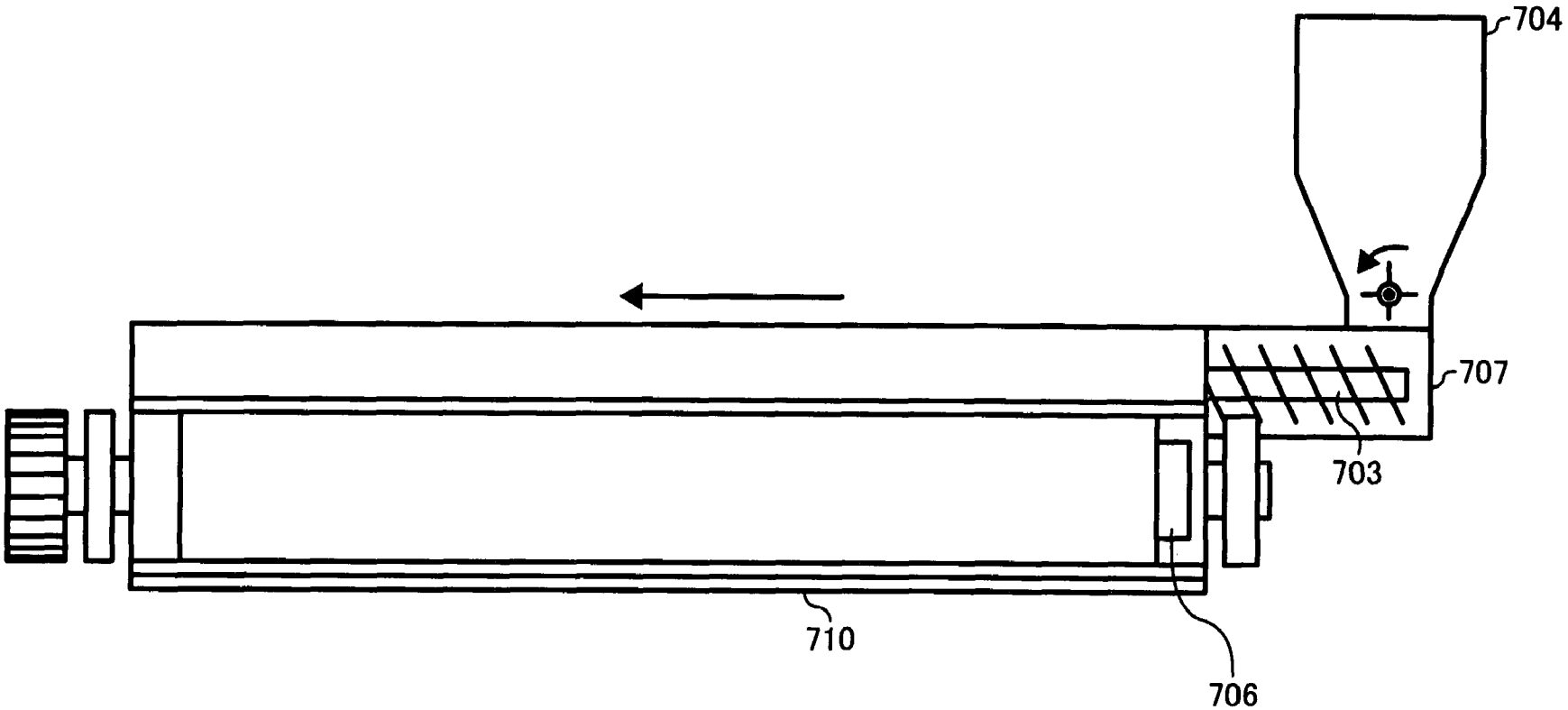
FIG. 14 is a plan view of the developing unit shown in FIG. 13.

FIGS. 13 and 14 are a sectional view and a front view, respectively, of a developing unit representative of an eighth embodiment of the present invention. As shown, the eighth embodiment differs from the first embodiment in that a developing unit, generally 700, operates with a single-ingredient developer, i.e., toner not mixed with a carrier. The developing unit 700 includes a developing roller 701, a paddle 702, a screw or conveying means 703, a hopper or developer storing section 704, a wall 705 configured to control the drop of toner, a toner sensor 706 and a conveying section 707.

In the illustrative embodiment, whether or not toner replenishment is necessary is determined in accordance with the output of the toner sensor 706 as in the first embodiment. If toner replenishment is necessary, the hopper 704 is driven to deliver toner, or developer, stored therein to the conveying section 707. The toner is then conveyed by the screw member 703 in the lengthwise direction of a casing 710 and dropped into the casing 710 along the wall 705, which is configured to control the amount of developer to drop. The toner thus introduced into the casing 710 is conveyed by the paddle 702 toward the developer 701 and then deposited on the developing roller 701. While the illustrative embodiment differs in configuration from the first embodiment because it uses a single-ingredient type developer, the former may execute toner replenishment control in exactly the same manner as the latter.

FIG. 15 shows the results of experiments conducted with the image forming apparatus of the first embodiment. In the experiments, the lightness (*L) of an output image is measured by varying the preselected period of time during which toner replenishment is not effected, as stated earlier, in order to estimate the variation of lightness, i.e., image density. For the experiments, a patch with lightness of around 50 was measured with all images formed on 1,000 sheets. In FIG. 15, a circle, a triangle and a cross are respectively representative of a lightness variation of above 0.0 inclusive, but below 5.0, a lightness variation of 5.0 or above, but below 10.0, and a lightness variation of 10.0 or above. For the measurement of lightness, use was made of a spectral reflection density sensor model 938 available from X-Rite.

In the first embodiment, a period of time T necessary for the developer to be circulated in the developing unit one time is assumed to be 7 seconds. In the above experiments, the lightness of an output image was measured by delaying a toner replenishing time t by 0% to 40% of the circulation time T. As FIG. 15 indicates, when the preselected period of time stated previously is at least 20% of the circulation time T, there can be obtained an image forming apparatus capable of outputting images with a minimum of lightness variation.

In summary, it will be seen that the present invention provides an image forming apparatus capable of preventing the density of an output image from noticeably varying in relation to the toner replenishing timing despite that the apparatus uses the combination of dark toner and light toner.

Various modifications will become possible for those skilled in the art after receiving the teachings of the present disclosure without departing from the scope thereof.

What is claimed is:

1. An image forming apparatus for forming a first toner image with a dark toner and a second toner image with a light toner and superposing said first toner image and said second toner image on a sheet for thereby outputting an image, said image forming apparatus comprising:

a first developing unit storing the dark toner;

a dark toner replenishing device for replenishing the dark toner to said first developing unit;

a second developing unit storing the light toner;

a light toner replenishing device for replenishing the light toner to said second developing unit; and a toner replenishment control unit for controlling operations of said dark toner replenishing device and said light toner replenishing device;

wherein said toner replenishment control unit stores a replenishment history of the light toner and a replenishment history of the dark toner and corrects, at the time of replenishment of the light toner, a light toner replenishing operation by referencing said replenishment history of said dark toner to thereby control the operation of said light toner replenishing device or corrects, at the time of replenishment of said dark toner, a dark toner replenishing operation by referencing said replenishment history of said light toner to thereby control the operation of said dark toner replenishing device.

2. The apparatus as claimed in claim 1, wherein said toner replenishment control unit causes, by referencing the replenishment history of the dark toner, said light toner replenishing device to operate on the elapse of a preselected period of time since an end of an operation of said dark toner replenishing device or causes, by referencing the replenishment history of the light toner, said dark toner replenishing device to operate on the elapse of a preselected period of time since an end of an operation of said light toner replenishing device.

3. The apparatus as claimed in claim 2, wherein assuming that the preselected period of time is t and that a period of time necessary for the dark toner or the light toner to be circulated in said first developing unit or said second developing unit, respectively, one time is T, there holds a relation of $T>t>0.2\times T$.

4. The apparatus as claimed in claim 1, wherein said first developing unit and said second developing unit each are configured to develop a latent image with a two-ingredient type developer made up of a carrier and a toner.

5. The apparatus as claimed in claim 4, wherein said first developing unit and said second developing unit each are configured to develop a latent image with a single-ingredient type developer constituted only by toner.

6. The apparatus as claimed in claim 4, wherein said toner replenishment control unit controls the operation of said dark toner replenishing device or the operation of said light toner replenishing device in accordance with an output of a permeability sensor disposed in said first developing unit or said second developing unit, respectively.

7. The apparatus as claimed in claim 4, wherein said toner replenishment control unit controls the operation of said dark toner replenishing device or the operation of said light toner replenishing device in accordance with an output of a reflectance sensor disposed in said apparatus and responsive to a reflectance of the dark toner or the light toner, respectively.

8. The apparatus as claimed in claim 4, wherein said toner replenishment control unit controls the operation of said dark toner replenishing device or the operation of said light toner replenishing device in accordance with an output of a write pixel counter disposed in said apparatus and assigned to the dark toner or the light toner, respectively.

9. The apparatus as claimed in claim 4, wherein said apparatus forms a color image with a plurality of combinations of dark toners and light toners of different hues, each of said plurality of combinations being of substantially a same hue.

10. An image forming apparatus for forming a first toner image with a dark toner and a second toner image with a light toner and superposing said first toner image and said second toner image on a sheet for thereby outputting an image, said image forming apparatus comprising:

a first developing unit storing the dark toner;

a dark toner replenishing device for replenishing the dark toner to said first developing unit;

a second developing unit storing the light toner;

a light toner replenishing device for replenishing the light toner to said second developing unit; and a toner replenishment control unit for controlling operations of said dark toner replenishing device and said light toner replenishing device;

wherein said toner replenishment control unit stores a replenishment history of the dark toner and corrects, at the time of replenishment of the light toner, a light toner replenishing operation by referencing said replenishment history of the dark toner to thereby control the operation of said light toner replenishing device.

11. The apparatus as claimed in claim 10, wherein said toner replenishment control unit causes, by referencing the replenishment history of the dark toner, said light toner replenishing device to operate on the elapse of a preselected period of time since an end of an operation of said dark toner replenishing device.

12. The apparatus as claimed in claim 11, wherein assuming that the preselected period of time is t and that a period of time necessary for the dark toner or the light toner to be circulated in said first developing unit or said second developing unit, respectively, one time is T, there holds a relation of $T>t>0.2\times T$.

13. The apparatus as claimed in claim 10, wherein said first developing unit and said second developing unit each are configured to develop a latent image with a two-ingredient type developer made up of a carrier and a toner.

14. The apparatus as claimed in claim 10, wherein said first developing unit and said second developing unit each are configured to develop a latent image with a single-ingredient type developer constituted only by toner.

15. The apparatus as claimed in claim 10, wherein said toner replenishment control unit controls the operation of said dark toner replenishing device or the operation of said light toner replenishing device in accordance with an output of a permeability sensor disposed in said first developing unit or said second developing unit, respectively.

16. The apparatus as claimed in claim 10, wherein said toner replenishment control unit controls the operation of said dark toner replenishing device or the operation of said light toner replenishing device in accordance with an output of a reflectance sensor disposed in said apparatus and responsive to a reflectance of the dark toner or the light toner, respectively.

17. The apparatus as claimed in claim 10, wherein said toner replenishment control unit controls the operation of said dark toner replenishing device or the operation of said light toner replenishing device in accordance with an output of a write pixel counter disposed in said apparatus and assigned to the dark toner or the light toner, respectively.

18. The apparatus as claimed in claim 10, wherein said apparatus forms a color image with a plurality of combinations of dark toners and light toners of different hues, each of said plurality of combinations being of substantially a same hue.

19. An image forming apparatus for forming a first toner image with a dark toner and a second toner image with a light toner and superposing said first toner image and said second toner image on a sheet for thereby outputting an image, said image forming apparatus comprising:

a first developing unit storing the dark toner;

a dark toner replenishing device for replenishing the dark toner to said first developing unit;

a second developing unit storing the light toner;

a light toner replenishing device for replenishing the light toner to said second developing unit; and a toner replenishment control unit for controlling operations of said dark toner replenishing device and said light toner replenishing device;

wherein said toner replenishment control unit stores a replenishment history of the light toner and corrects, at the time of replenishment of the dark toner, a dark toner replenishing operation by referencing said replenishment history of the light toner to thereby control the operation of said dark toner replenishing device.

20. The apparatus as claimed in claim 19, wherein said toner replenishment control unit causes, by referencing the replenishment history of the light toner, said dark toner replenishing device to operate on the elapse of a preselected period of time since an end of an operation of said light toner replenishing device.

21. The apparatus as claimed in claim 20, wherein assuming that the preselected period of time is t and that a period of time necessary for the dark toner or the light toner to be circulated in said first developing unit or said second developing unit, respectively, one time is T, there holds a relation of $T>t>0.2\times T$.

22. The apparatus as claimed in claim 19, wherein said first developing unit and said second developing unit each are configured to develop a latent image with a two-ingredient type developer made up of a carrier and a toner.

23. The apparatus as claimed in claim 22, wherein said first developing unit and said second developing unit each are configured to develop a latent image with a single-ingredient type developer constituted only by toner.

24. The apparatus as claimed in claim 22, wherein said toner replenishment control unit controls the operation of said dark toner replenishing device or the operation of said light toner replenishing device in accordance with an output of a permeability sensor disposed in said first developing unit or said second developing unit, respectively.

25. The apparatus as claimed in claim 22, wherein said toner replenishment control unit controls the operation of said dark toner replenishing device or the operation of said light toner replenishing device in accordance with an output of a reflectance sensor disposed in said apparatus and responsive to a reflectance of the dark toner or the light toner, respectively.

26. The apparatus as claimed in claim 22, wherein said toner replenishment control unit controls the operation of said dark toner replenishing device or the operation of said light toner replenishing device in accordance with an output of a write pixel counter disposed in said apparatus and assigned to the dark toner or the light toner, respectively.

27. The apparatus as claimed in claim 22, wherein said apparatus forms a color image with a plurality of combinations of dark toners and light toners of different hues, each of said plurality of combinations being of substantially a same hue.

* * * * *